US005749395A

United States Patent [19]

Hayashi et al.

[11] Patent Number: 5,749,395

[45] Date of Patent: May 12, 1998

[54] SELECTOR VALVE AGGREGATE

[75] Inventors: Bunya Hayashi; Yoshio Asou; Makoto Ishikawa, all of Yawara-mura, Japan

[73] Assignee: SMC Corporation, Tokyo, Japan

[21] Appl. No.: 797,412

[22] Filed: Feb. 10, 1997

Related U.S. Application Data

[63] Continuation of Ser. No. 560,705, Nov. 20, 1995, abandoned.

[30] Foreign Application Priority Data

Dec. 27, 1994 [JP] Japan ..... 6-338126

[51] Int. Cl.[6] ..... F15B 13/08

[52] U.S. Cl. ..... 137/596.16; 137/884

[58] Field of Search ..... 137/271, 596.16, 137/884

[56] References Cited

U.S. PATENT DOCUMENTS

| | | | |
|---|---|---|---|
| 3,464,444 | 9/1969 | Tennis | 137/596.12 |
| 3,550,621 | 12/1970 | Lansky et al. | 137/884 |
| 3,605,805 | 9/1971 | Worrix | 137/596.12 |
| 3,858,606 | 1/1975 | Cameron | 137/596.16 |
| 3,918,489 | 11/1975 | Foster et al. | 137/596.16 |
| 4,215,721 | 8/1980 | Hetherington et al. | 137/884 X |
| 4,535,809 | 8/1985 | Andersson | 137/596.14 |
| 4,535,821 | 8/1985 | Anderson | 137/884 |
| 4,718,451 | 1/1988 | Kosugi | 137/884 X |
| 5,437,306 | 8/1995 | Asou et al. | 137/884 X |
| 5,462,087 | 10/1995 | Fukano et al. | 137/625.64 X |
| 5,558,126 | 9/1996 | Hayashi et al. | 137/625.64 |
| 5,597,015 | 1/1997 | Asou et al. | 137/884 X |

FOREIGN PATENT DOCUMENTS

| | | |
|---|---|---|
| 0 628 729 | 12/1994 | European Pat. Off. . |
| 0 661 484 | 7/1995 | European Pat. Off. . |
| 35 30 019 | 6/1986 | Germany . |

*Primary Examiner*—Gerald A. Michalsky

*Attorney, Agent, or Firm*—Oblon, Spivak, McClelland, Maier & Neustadt, P.C.

[57] ABSTRACT

A highly integrated selector valve aggregate of a compact size, by which it is possible to reduce the length dimension thereof and which includes a plurality of selector valves arranged in a connecting direction. A composite type selector valve thereof includes a plurality of selector valve mechanisms interconnected in a valve body wherein a plurality of the composite type selector valves are joined in a lateral direction and are connected together.

1 Claim, 5 Drawing Sheets

SELECTOR VALVE AGGREGATE

This application is a Continuation of application Ser. No. 08/560,705, filed on Nov. 20, 1995, now abandoned.

BACKGROUND OF THE INVENTION

1. Field of the Invention

The present invention relates to a selector valve aggregate, which comprises a plurality of selector valves integrally connected with each other.

2. Discussion of the Background

A technique has been known in the art, in which a plurality of selector valves are used as a set of selector valves aggregated by connecting these selector valves with each other in order to collectively supply and discharge pressure fluid to these selector valves. For example, a plurality of selector valves are aligned and mounted on a manifold base having supply bores and discharge bores for the pressure fluid or a selector valve is installed on a sub-plate having supply bores and discharge bores and a given number of such sub-plates with the selector valves are joined together in a lateral direction. Further, in case of a stacking type selector valve, which comprises a valve body with supply bores and discharge bores, a plurality of selector valves are directly joined and linked together without using the manifold base or the sub-plate as mentioned above.

However, in case a set of selector valve aggregates is formed by aligning the selector valves in a lateral direction and by joining them together, the more selector valves there are, the longer the selector valve aggregate is in a lateral dimension (in a linking or connecting direction). If the space for installation is limited, this often leads to difficulty.

It is an object of the present invention to provide a selector valve aggregate of a compact size and with high integration, in which the length of the selector valve aggregate comprising a plurality of selector valves is reduced in connecting direction.

SUMMARY OF THE INVENTION

To attain the above object, the present invention provides a selector valve aggregate, in which a given number of composite type selector valves comprising a plurality of selector valves for switching over the flow of pressure fluid and being incorporated vertically in multiple stages are connected together in a lateral direction.

According to a concrete aspect of the present invention, the selector valve aggregate of the present invention comprises a plurality of selector valve mechanisms incorporated in a composite type selector valve, wherein each of the selector valve mechanisms comprises valve members for switching over the flow of the pressure fluid and a driving mechanism for driving said valve members, said valve members being arranged vertically in multiple stages within a valve body, and said driving mechanism being integrally assembled on said valve body, said valve body comprising joint surfaces for connection being formed on both sides thereof in a lateral direction and a supply bore and discharge bores for the pressure fluid leading to each of the selector valve mechanisms, said bores being opened on the joint surfaces and communicated with bores of an adjacent composite type selector valve and an output port separately communicated with each of the selector valve mechanisms being provided on a port block on a front end surface of the valve body.

According to another embodiment of the present invention, a common output port is provided for each of the selector valve mechanisms instead of providing an output port separately for each selector valve mechanism in said port block.

In the present invention, said driving mechanism may be designed as an electromagnetically operated pilot valve.

Also, the present invention provides a composite type selector valve, which comprises a plurality of selector valve mechanisms for switching over the flow of a pressure fluid, and said selector valve mechanisms being incorporated vertically in multiple stages.

Because a plurality of selector valve mechanisms are incorporated vertically in multiple stages within a selector valve in each of the composite type selector valves, which constitute a selector valve aggregate, this is substantially the same as a plurality of selector valves connected within the width of a selector valve. Therefore, in case a plurality of composite type selector valves are connected together in a lateral direction with Joint surfaces in contact with each other, the length in a connecting direction of the selector valve aggregate thus formed is extensively reduced as compared with the case where as many selector valves as all the selector valve mechanisms are connected together in lateral direction. As a result, a highly integrated selector valve aggregate of a compact size can be obtained.

Various other objects, features and attendant advantages of the present invention will be more fully appreciated as the same becomes better understood from the following detailed description when considered in connection with the accompanying drawings in which like reference characters designate like or corresponding parts throughout the several views and wherein:

DESCRIPTION OF THE PREFERRED EMBODIMENTS

Figure 1:
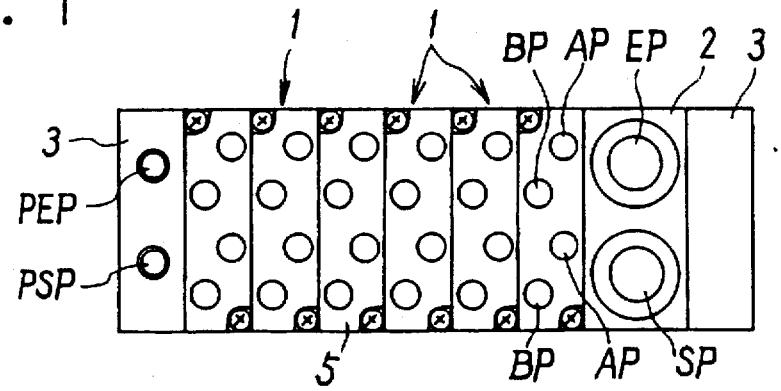
FIG. 1 is a front view of a selector valve aggregate according to the present invention.
Figure 2:
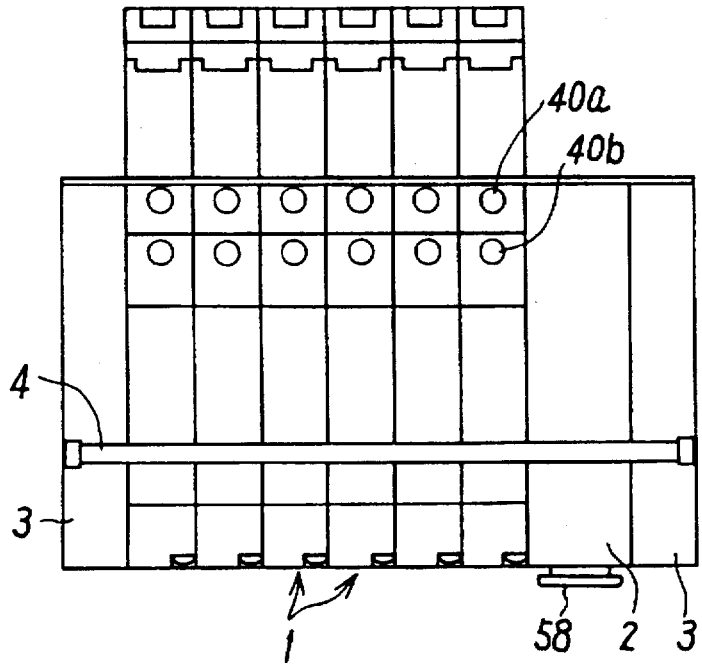
FIG. 2 is a plan view of the selector valve aggregate of FIG. 1.
Figure 3:
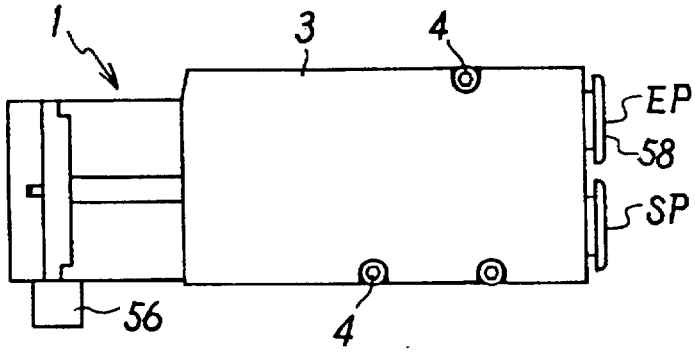
FIG. 3 is a side view of the selector valve aggregate of FIG. 1.
Figure 4:
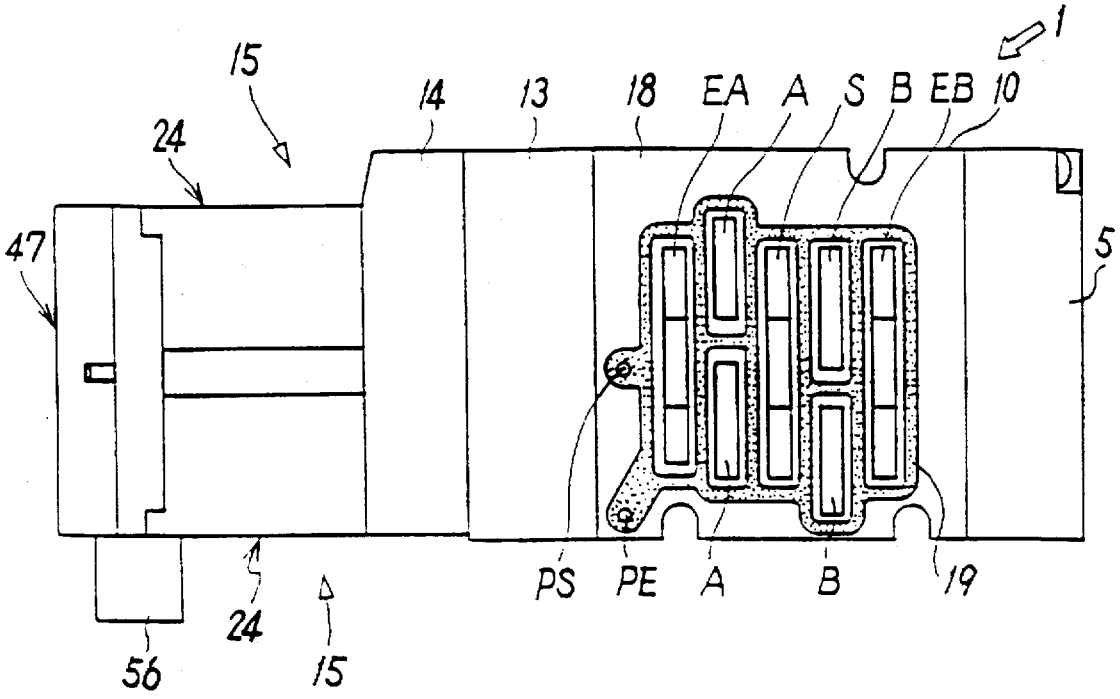
FIG. 4 is a side view of a composite type selector valve.
Figure 5:
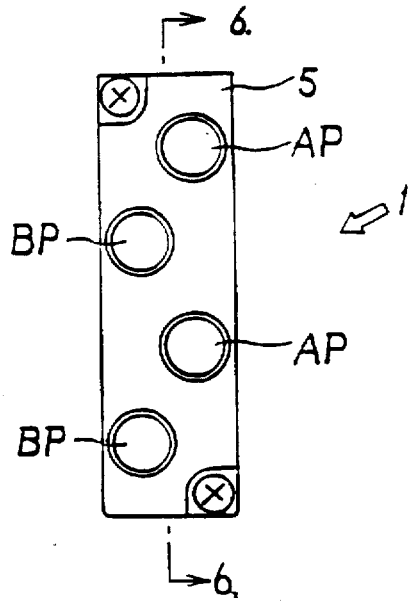
FIG. 5 is a front view of the composite type selector valve of FIG. 4.

FIG. 1 to FIG. 3 each represents a selector valve aggregate, which is formed by collectively joining a plurality of composite type selector valves. This selector valve aggregate can be assembled by joining a plurality of composite selector valve, 1, 1, and a port block 2 for supply discharge, and two side plates 3 and 3 positioned at left and right ends are joined together in lateral direction and are integrally fixed by upper and lower fastening means 4.

As shown in FIG. 4 to FIG. 8, in the composite selector valve 1 as described above, two sets of independently functioning selector valve mechanisms *6a* and *6b* used for switching over flow of pressure fluid such as compressed air are incorporated vertically in multiple stages in a selector valve. The concrete arrangement is as described below. In the figures, two sets of selector valve mechanisms are incorporated, while three sets or more may be incorporated.

Specifically, as it is evident from FIG. 4 to FIG. 7, the composite type selector valve 1 comprises a valve body 10 in the shape of a rectangular parallelopiped. Upper and lower valve bores 11 and 11 are formed inside the valve body 10, and spool type valve members 12 and 12 are slidably incorporated in these valve bores 11 of the selector valve mechanisms 6a and 6b. On one end surface in an axial direction (rear end surface) of the valve bore of the valve body 10, first and second sub-bodies 13 and 14 are mounted, and two sets of driving mechanisms 15 and 15 for driving the above two valve members 12 and 12 are assembled on these sub-bodies 13 and 14.

Both sides in lateral direction of the valve body constitute joint surfaces 18 and 18 to be joined with the adjacent composite selector valve 1. On these joint surfaces 18 and 18, a supply bore B and discharge bores EA and EB used for pressure fluid and communicated with the valve bores 11 and 11 are formed. When a plurality of the composite selector valves 1 are joined together via a sealing member 19, the supply bore S and the discharge bores EA and EB of the composite selector valve 1 are communicated with those of the other composite selector valve 1. As shown in the figures, the supply bore S and the discharge bores EA and EB may be commonly communicated with the two valve bores 11 and 11 or they may be independently furnished for each valve bore.

On the joint surfaces 18 of one of the valve bodies 10, two sets of output bores A and B independently communicated with the valve bores 11 and 11 are formed. These output bores A and B are closed by the valve bodies 10 of the adjacent composite type selector valves 1 when the composite type selector valves 1 are joined together so that they are not communicated with output bores of the other selector valves. These output bores A and B are independently communicated with the output ports AP and BP opened on front surface of a port block 5 for output as mounted on a forward end surface of the valve body 10. These output ports AP and BP are provided so as to correspond to the selector valve mechanisms 6a and 6b, and are arranged above and below.

Each of the driving mechanisms 15 and 15 is provided as an electromagnetically operated pilot valve in the embodiment shown in the figures. Thus, each of the selector valve mechanisms 6a and 6b function as a single solenoid type selector valve as already known in the art.

Specifically, on one end in an axial direction of each valve member 12, a return pressure chamber 21 for applying pilot fluid pressure on an end surface of the valve member 12 is provided. In contrast, on the other end of the valve member 12, a piston chamber 23 with a built-in piston 22 having a diameter larger than that of the valve member 12 is formed on a first sub-body 13. The return pressure chamber 21 is always communicated with a pilot supply bore PS passing through the valve body 10 via a flow passage 28. On the other hand, the piston chamber 23 is connected to the pilot supply bore PS via a pilot valve through a flow passage 29a (in case of the upper selector valve mechanism 6a) or flow passages 29b and 29c (in case of the lower selector valve mechanism 6b). The pilot supply bore PS is communicated with a pilot supply port PSP (FIG. 1) formed on the side plate 3.

Each of the driving mechanisms 15 and 15 comprises a solenoid mechanism 14 of a known type for bringing a moving iron core 26 to or from a fixed iron core 27 by turning power on or off to a coil 25, a pilot supply valve seat 30 and a pilot discharge valve seat 31 provided back-to-back on a second sub-body 14, and a pilot supply valve disc 32 and a pilot discharge valve disc 33 for opening or closing the pilot supply valve seat 30 and the pilot discharge valve seat 31, and the pilot supply valve disc 32 is mounted on the movable iron core 26 of the solenoid mechanism 24.

The two sets of the solenoid mechanisms 24 and 24 are integrally molded.

When power is connected to the coil 25 and the moving iron core 26 is moved to the fixed iron core 27, the pilot supply valve seat 30 is opened, and the pilot discharge valve seat 31 is closed. Then, the pilot fluid flows from the pilot supply bore PS into a pilot supply valve chest, to which the pilot supply valve seat 30 is opened, through a flow passage 35 and the pilot supply valve seat 30. Then, it passes through a flow passage (not shown) and flows into a pilot discharge valve chest, to which the pilot discharge valve seat 31 is opened. It passes through a flow passage 29a in the upper selector valve mechanism 6a, and through flow passage 29c and 29b in the lower selector valve mechanism 6b and flows into the piston chamber 23. As a result, the piston 22 is pushed rightward as shown in the lower half of the figure and moves the valve member 12 toward the right. Then, the supply bore S is communicated with the output bore A, and the discharge bore EB is communicated with the output bore B.

When the power to the coil 25 is turned off to return the moving iron core 26, the pilot supply valve seat 30 is closed, and the pilot discharge valve seat 31 is opened. Then, the pilot fluid in the piston chamber 23 passes through the pilot discharge valve seat 31 from the flow passages 29a or 29b and 29c into a flow passage 37, and it is discharged to outside from a pilot discharge port PEP on the side plate 3 via the pilot discharge bore PE, which passes through the valve body 10. Therefore, by the action of the pilot fluid pressure in the return pressure chamber 21, the valve member 12 and the piston 22 are pushed leftward as shown in the upper half of the figure. Thus, the supply bore S is communicated with the output bore B, and the discharge bore EA is communicated with the output bore A.

In the upper selector valve mechanism 6a, the piston chamber 23 is directly communicated with the pilot valve through the flow passage 29a, while, in the lower selector valve mechanism 6b, the piston chamber 23 is communicated with the pilot valve via a manual operating mechanism 40b provided in the middle of the flow passages 29b and 29c, but the functions of the two selector valve mechanisms 6a and 6b are the same. The arrangement and the function of the manual operating mechanism 40b are as follows:

In the selector valve mechanisms 6a and 6b, manual operating mechanisms 40a and 40b are provided respectively in order that the valve members 12 can be switched over to manual operation when the solenoid mechanism 24 cannot be used due to reasons such as power suspension.

The manual operating mechanism 40a, which corresponds to the upper selector valve mechanism 6a, comprises an operating shaft 43a with its forward end tapered, and the operating shaft 43a is inserted into a bore of the second sub-body 14 so that it can be moved up and down, and it is pushed upward by a spring 44a. In this manual operating mechanism, when the operating shaft 43a is in non-operating condition, i.e. when it is pushed by the spring 44a and is at upper position, its forward end is separated from the moving iron core 26 of the solenoid mechanism 24. When the operating shaft 43a is pushed in against the force of the spring 44*a*, the side of its forward end is brought into contact with the moving iron core 26 and moves the moving iron core 26 toward the fixed iron core 27, and the pilot supply valve seat 30 is opened. This is substantially the same condition as the case where power is connected to the upper solenoid mechanism 24.

Figure 6:
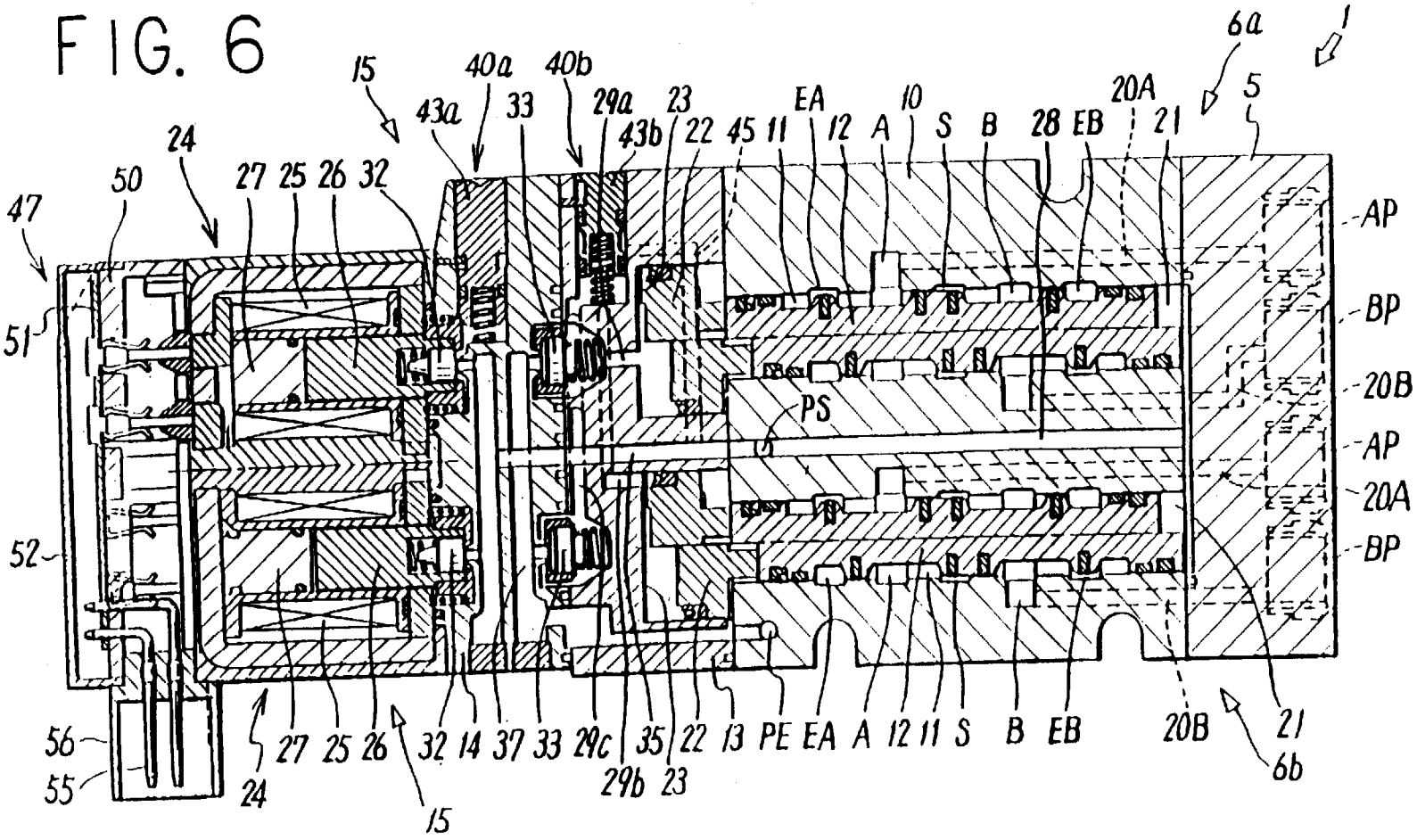
FIG. 6 is an enlarged cross-sectional view taken along the line 6—6 in FIG. 5.
Figure 7:
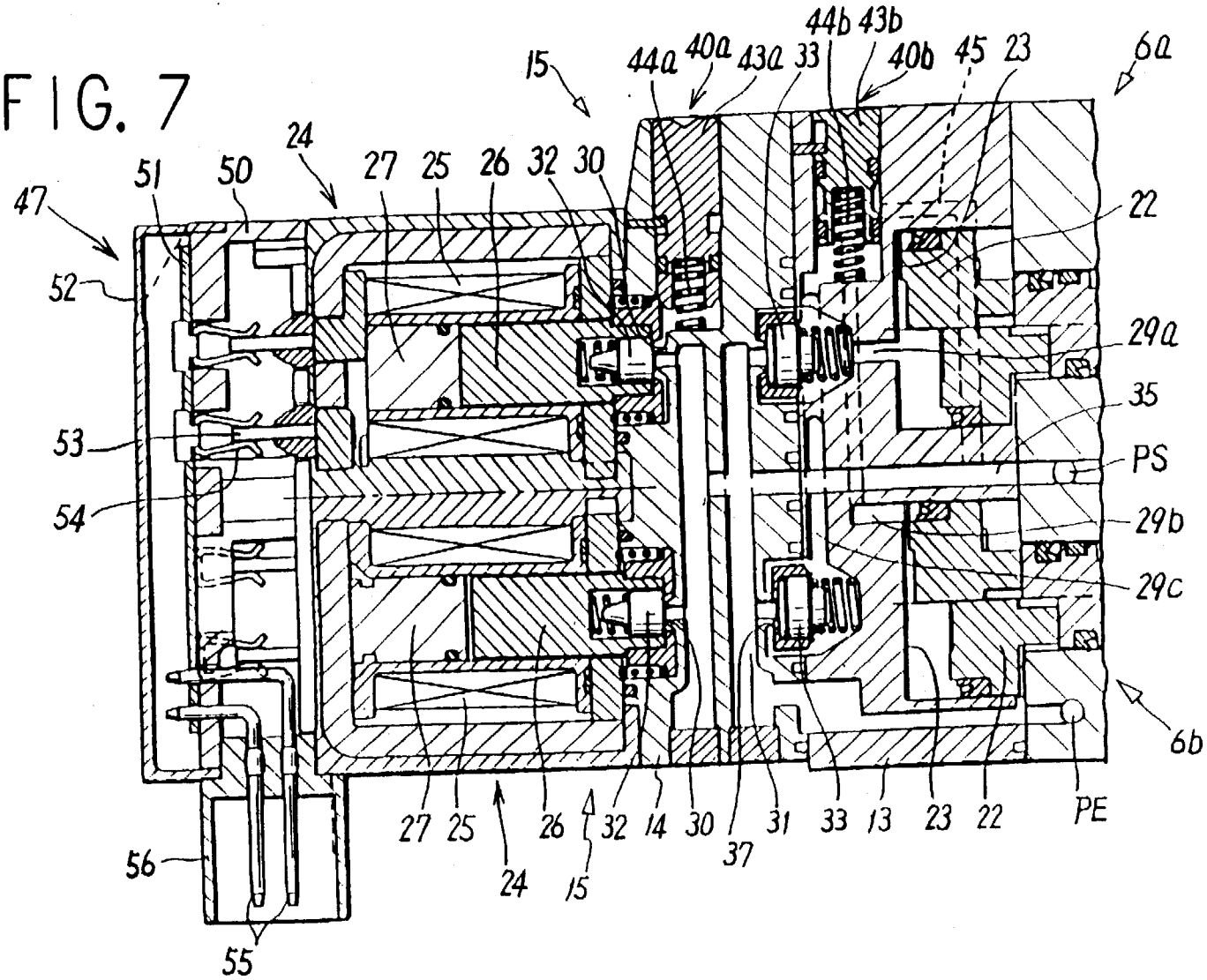
FIG. 7 is an enlarged view of an essential part of the selector valve of FIG. 6.
Figure 8:
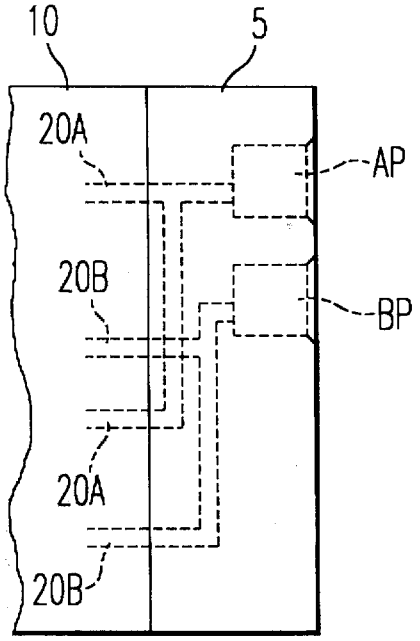
FIG. 8 shows the outlet port of the selection valves.

In the manual operating mechanism 40*b* which corresponds to the lower selector valve mechanism 6*b*, an operating shaft 43*b* is inserted into a bore, to which a flow passage 45 communicating with the pilot supply bore PS and the flow passages 29*b* and 29*c* connecting the piston chamber 23 with the pilot valve are opened, so that the operating shaft can be moved freely up and down, and it is pushed upward by a spring 44*b*. In this manual operating mechanism, when the operating shaft 43*a* is in a non-operating condition, i.e. when it is pushed by the spring 44*a* and is at upper position, the flow passage 45 is blocked as shown in FIGS. 6 and 7, and the flow passages 29*b* and 29*c* are communicated with each other. When the operating shaft 43*a* is pushed in against the force of the spring 44*a*, the flow passages 45 and 29*b* are communicated with each other. The pilot fluid is supplied into the piston chamber 23, and the flow passage 29*c* is blocked. This is substantially the same condition as in the case where power is connected to the lower solenoid mechanism 24.

The operating shafts 43*a* and 43*b* of the manual operating mechanisms 40*a* and 40*b* may be designed in such manner that they can be locked at the operating positions thereof.

On the pilot valve, a power feeding means 47 for feeding power to the solenoid mechanisms 24 and 24 is removably arranged. This power feeding means 47 comprises a terminal block 40 mounted on the solenoid mechanism 24 by adequate means such as bolt, a terminal strip 51 supported on the terminal block 50 and a terminal cover 52 to cover the terminal strip 51.

The terminal strip 51 with wiring printed on its surface comprises electrical parts such as indicator lamp, counter-electromotive force preventive device, etc. in addition to as many power feeding terminals 54 as power receiving terminals 53 protruded from each solenoid mechanism 24. On the lower end of the terminal strip 51, a terminal box 56 equipped with a plug terminal 55 for power connection is removably mounted by inserting the tip of the plug terminal into a hole of the terminal strip 51.

The terminal cover 52 to cover the terminal strip 51 has a plurality of engaging holes on its side, and by engaging pawls on outer side of the terminal block 50 into these engaging holes, the terminal cover is removably mounted on the terminal block 50.

In FIG. 1 to FIG. 3, joint surfaces are provided on two sides in lateral direction of the port block 2 for supply and discharge to connect to the composite type selector valve 1 and the side plate 3. On the joint surfaces, supply bores and discharge bores communicated with the supply bore S and the discharge bores EA and EB of the composite type selector valve 1 are formed, and a supply port SP communicated with the supply bore S and a discharge port EP communicated commonly with the discharge bores EA and EB are provided on the front surface of the port block 2 for supply and discharge. It is desirable that the supply port SP and the discharge port EP are provided with a single-acting tube fitting 58, which can be connected in fall-stop condition by simply inserting a tube.

Further, each of the side plates 3, 3 at the left and right ends of the selector valve aggregate has joint surface on inner side. By linking the joint surface with the composite type selector valve 1 or the port block 2 for supply and discharge, the supply bore S and the discharge bores EA and EB are closed.

In the embodiment shown in the figures, the pilot fluid can be supplied from outside by furnishing a pilot supply port PSP and a pilot discharge port PEP separately from the supply port SP and the discharge port EP for a main fluid, while it is also possible to use the ports in common by communicating the pilot supply bore PS and the pilot discharge bore PE with the supply port SP and the discharge port EP of the port block 2 for supply and discharge. In this case, it is needless to say that there is no need to provide the pilot supply port PSP and the pilot discharge port PEP.

Thus, by connecting a given number of the composite type selector valves in lateral direction, the selector valve aggregate can be obtained. Because a plurality of selector valve mechanisms 6*a* and 6*b* are incorporated vertically in multiple stages within a selector valve in the composite type selector valve 1, it is substantially the same as a plurality of selector valves connected together within the width of a selector valve. Therefore, the length of the selector valve aggregate in connecting direction can be extensively reduced compared with the case where as many selector valves as compared with all the selector valve mechanisms 6*a* and 6*b* are connected in lateral direction. For example, in case the selector valve mechanisms 6*a* and 6*b* are incorporated in two stages in the composite type selector valve 1, the length of the selector valve aggregate in connecting direction can be reduced to by nearly one-half are compared with the case where as many selector valves as comprise all the selector valve mechanisms 6*a* and 6*b* are connected in lateral direction.

As a further embodiment of the present invention, as many output ports AP and BP corresponding to a single selector valve mechanism may be provided instead of providing as many output ports AP and BP corresponding to a plurality of selector valve mechanisms 6*a* and 6*b* in the output port block 5, and by communicating the output bores A or B of the selector valve mechanisms 6*a* and 6*b* with the output ports AP or BP and by simultaneously switching over the valve members 12 and 12, the fluid may be supplied at a flow rate corresponding to total number of the selector valve mechanisms 6*a* and 6*b*.

In the embodiments described above, the driving mechanism 15 for driving the valve member 12 is designed as an electromagnetically operated pilot valve, while operating system and overall arrangement are not limited to this type, and it may be another type of pilot valve using an operating force other than electromagnetic force. Alternatively, instead of the pilot valve, another type of driving mechanism may be used, in which the valve member can be directly switched over by an electrical or mechanical operating force.

Although the selector valve mechanisms 6*a* and 6*b* are designed as 5-port valves, they may be designed as other types such as 3-port valves or 4-port valves.

Further, the selector valve aggregate as described above can be installed on adequate mounting members such as a rail, manifold base, etc., and two sets or more of the selector valve aggregates may be arranged in line.

As described above, it is possible according to the present invention to extensively reduce the length of the selector valve aggregate in the connecting direction and to design a highly integrated selector valve aggregate in compact size compared with the case where as many selector valves as all the selector valve mechanisms are connected in lateral direction because a composite type selector valve is arranged in which a plurality of selector valve mechanisms are incorporated vertically in multiple stages within a selector valve and a selector valve aggregate is obtained by connecting a given number of such composite type selector valves in a lateral direction.

Obviously, numerous modifications and variations of the present invention are possible in light of the above teachings. It is therefore to be understood that within the scope of the appended claims, the invention may be practiced otherwise than as specifically described herein.

What we claim are:

1. A selector valve aggregate, which comprises:

a plurality of composite type selector valves which are interconnected in a row wherein each of said composite type selector valves comprises a plurality of selector valve mechanisms, said valve mechanisms switching over a flow of a pressure fluid and being interconnected; and a longitudinally elongated rectangular valve body having a small width dimension and a height dimension greater than the width dimension, in which said plurality of selector valve mechanisms are positioned, said valve mechanisms independently switching over the flow of the pressure fluid and being positioned in a vertical arrangement in said valve body wherein a plurality of said composite type selector valves are arranged in a lateral direction;

wherein each of the selector valve mechanisms comprises a plurality of valve members switching over the flow of the pressure fluid and a driving mechanism driving said valve members, said valve members being interconnected within said valve body and said driving mechanism being integrally assembled with said valve body;

said valve body comprising joint surfaces formed on both sides thereof in said lateral direction thereof wherein a supply bore and discharge bores are provided in said valve body which communicate pressure fluid leading to each of the selector valve mechanisms, said bores being opened to and being communicated with bores of an adjacent composite type selector valve; and an output port which is communicated with each of the selector valve mechanisms and which is provided on a port block on a front end surface of the valve body and wherein said driving mechanism comprises an electromagnetically operated pilot valve.

* * * * *